US011092055B2

(12) United States Patent
Kawakami et al.

(10) Patent No.: US 11,092,055 B2
(45) Date of Patent: Aug. 17, 2021

(54) HONEYCOMB STRUCTURE

(71) Applicant: NGK Insulators, Ltd., Nagoya (JP)

(72) Inventors: Akifumi Kawakami, Nagoya (JP); Yasuyuki Furuta, Nagoya (JP); Mitsuhiro Ito, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 295 days.

(21) Appl. No.: 16/398,464

(22) Filed: Apr. 30, 2019

(65) Prior Publication Data

US 2019/0353074 A1 Nov. 21, 2019

(30) Foreign Application Priority Data

May 17, 2018 (JP) ..... JP2018-095132

(51) Int. Cl.
*F01N 3/28* (2006.01)
*F01N 13/00* (2010.01)

(52) U.S. Cl.
CPC ..... *F01N 3/2828* (2013.01); *F01N 13/017* (2014.06); *F01N 2330/34* (2013.01)

(58) Field of Classification Search
CPC ..... F01N 3/2828; F01N 2510/06; F01N 2330/48; F01N 3/0222; F01N 13/017; F01N 3/2803
USPC ..... 55/523; 428/116; 422/180
See application file for complete search history.

(56) References Cited

U.S. PATENT DOCUMENTS 5,108,685 A * 4/1992 Kragle ..... B28B 3/269 264/177.12
5,916,133 A * 6/1999 Buhrmaster ..... F01N 3/0878 60/297
9,073,289 B2 * 7/2015 Tamai ..... B01D 46/2474
9,403,339 B2 * 8/2016 Murata ..... B32B 3/12
2002/0042344 A1 4/2002 Kondo et al.
(Continued)

FOREIGN PATENT DOCUMENTS

DE 11 2013 000 714 T5 11/2014
GB 2 342 055 A 4/2000
(Continued)

OTHER PUBLICATIONS

German Office Action (Application No. 10 2019 207 030.2) dated Jan. 13, 2021 (with English translation).

*Primary Examiner* — Tom P Duong
(74) *Attorney, Agent, or Firm* — Burr & Brown, PLLC

(57) ABSTRACT

A honeycomb structure including:

a pillar-shaped honeycomb structure body, the honeycomb structure body being configured to include a circumferential portion and a central portion, wherein a shape of the cells is a triangle or a hexagon having at least one symmetrical axis, in the shape of the cells, a number of the symmetrical axes is defined as A, a number of vertices of the shape of the cells is defined as N, and a value shown in a following Equation (1) is defined as θ, an arrangement direction of the cells in the circumferential portion is inclined in a range of θ−15° to θ+15° with respect to an arrangement direction of the cells in the central portion.

$$\theta = \frac{180}{A} \cdot \frac{N}{6} \qquad \text{Equation (1)}$$

6 Claims, 3 Drawing Sheets

(56) References Cited

U.S. PATENT DOCUMENTS

| | | | | |
|---|---|---|---|---|
| 2004/0071932 | A1* | 4/2004 | Ishihara | B01D 46/2459 428/116 |
| 2004/0131512 | A1* | 7/2004 | Abe | B01D 46/0024 422/180 |
| 2011/0162348 | A1* | 7/2011 | Kim | F01N 13/009 60/274 |
| 2014/0205794 | A1* | 7/2014 | Tamai | B01D 46/247 428/116 |
| 2014/0287192 | A1* | 9/2014 | Murata | F01N 3/2828 428/117 |
| 2015/0004353 | A1 | 1/2015 | Hayashi et al. | |
| 2015/0005153 | A1* | 1/2015 | Hayashi | C04B 35/195 502/87 |

FOREIGN PATENT DOCUMENTS

| | | | |
|---|---|---|---|
| JP | 2000-097019 | A1 | 4/2000 |
| JP | 2002-177794 | A1 | 6/2002 |
| JP | 2008-018370 | A1 | 1/2008 |

* cited by examiner

HONEYCOMB STRUCTURE

The present application is an application based on JP-2018-095132 filed on May 17, 2018 with Japan Patent Office, the entire contents of which are incorporated herein by reference.

BACKGROUND OF THE INVENTION

Field of the Invention

The present invention relates to a honeycomb structure. More particularly, the present invention relates to a honeycomb structure that can suppress the decrease in isostatic strength.

Description of the Related Art

There is conventionally used a honeycomb structure onto which a catalyst is loaded in order to purify harmful substances such as HC, CO, and NOx contained in exhaust gas emitted from an engine of an automobile etc. Moreover, the honeycomb structure is also used as a filter for exhaust gas purification by plugging the open ends of cells defined by a porous partition wall.

The honeycomb structure is a pillar-shaped structure that includes partition walls defining a plurality of cells which function as through channels for exhaust gas. Such the honeycomb structure has a cell structure in which the plurality of cells is regularly arranged in a predetermined cycle in its plane perpendicular to an extending direction of the cells. Conventionally, one honeycomb structure has one type of cell structure in the above plane. However, with the aim of the improvement etc. of exhaust gas purification efficiency in recent years, there has been proposed a honeycomb structure that has two or more types of cell structures in the above plane. For example, there has been proposed a honeycomb structure in which a cell density or a cell shape varies in a central portion and a circumferential portion of a plane perpendicular to a cell extending direction, whereby the honeycomb structure has two or more types of cell structures in the above plane (e.g., see Patent Documents 1 to 3).

[Patent Document 1] JP-A-2002-177794

[Patent Document 2] JP-A-2008-018370

[Patent Document 3] JP-A-2000-097019

Patent Documents 1 to 3 disclose, as a honeycomb structure having two or more types of cell structures, for example, a honeycomb structure etc. that are configured to have high cell density in the central portion and low cell density in the circumferential portion in the plane perpendicular to the cell extending direction. Moreover, as a honeycomb structure having two or more types of cell structures, there has been disclosed a honeycomb structure in which a shape varies in the central portion and the circumferential portion in the plane perpendicular to the cell extending direction.

In such the honeycomb structure, when the arrangement direction of the cells in the central portion and the arrangement direction of the cells in the circumferential portion are configured to be inclined with respect to each other, there is a problem that mechanical strength such as isostatic strength of this honeycomb structure is greatly decreased. In particular, in such the honeycomb structure, due to a pressure from the outside or a thermal stress under high temperature environment, distortion is easy to occur in the partition walls disposed to surround the cells and results in the decrease in mechanical strength. For this reason, in the conventional honeycomb structure having two or more types of cell structures, it was extremely difficult to ensure stable mechanical strength.

The present invention has been achieved in view of the problems of the above conventional technology. An object of the invention is to provide a honeycomb structure that can suppress the decrease in isostatic strength.

SUMMARY OF THE INVENTION

According to the present invention, there is provided a honeycomb structure to be described below.

[1] A honeycomb structure comprising:

a pillar-shaped honeycomb structure body that includes porous partition walls arranged to surround a plurality of cells functioning as fluid through channels extending from a first end face to a second end face, the honeycomb structure body being configured to include a circumferential portion that includes an outermost circumference in a cross section perpendicular to a direction of extension of the cells of the honeycomb structure body and a central portion that is arranged in a central portion excluding the circumferential portion in the cross section, wherein in the cross section perpendicular to the direction of extension of the cells, a shape of the cells is a triangle or a hexagon having at least one symmetrical axis, and a shape of the cells formed in the central portion and a shape of the cells formed in the circumferential portion are congruent or similar shapes, in the shape of the cells, a number of the symmetrical axes is defined as A, a number of vertices of the shape of the cells is defined as N, and a value shown in a following Equation (1) is defined as θ, an arrangement direction of the cells in the circumferential portion is inclined in a range of θ−15° to θ+15° with respect to an arrangement direction of the cells in the central portion.

$$\theta = \frac{180}{A} \cdot \frac{N}{6} \qquad \text{Equation (1)}$$

[2] The honeycomb structure according to claim 1, wherein the honeycomb structure body further includes a boundary wall that is disposed in a boundary portion between the central portion and the circumferential portion.

[3] The honeycomb structure according to claim 1, wherein a boundary portion between the central portion and the circumferential portion in the honeycomb structure body is configured by the partition walls that is continuous or discontinuous.

[4] The honeycomb structure according to any one of claims 1 to 3, wherein a hydraulic diameter of the cells formed in the central portion is smaller than a hydraulic diameter of the cells formed in the circumferential portion.

[5] The honeycomb structure according to any one of claims 1 to 4, wherein a cell density in the central portion is larger than a cell density in the circumferential portion.

[6] The honeycomb structure according to any one of claims 1 to 5, further comprising plugging portions that are arranged at either end of the first end face or the second end face of the cells.

Effects of the Invention

The honeycomb structure according to the present invention has an effect that the decrease in isostatic strength can be suppressed. In other words, the honeycomb structure according to the present invention is configured so that the cell shape is a triangle or a hexagon having at least one symmetrical axis and the cell shape formed in the central portion and the cell shape formed in the circumferential portion are congruent or similar shapes. Moreover, in the honeycomb structure according to the present invention, assuming that a value indicated in the above Equation (1) is defined as θ, the arrangement direction of the cells in the circumferential portion is inclined in the range of θ−15° to θ+15° with respect to the arrangement direction of the cells in the central portion. By employing such the configuration, even when a pressure from the outside or a thermal stress under high temperature environment is added, distortion is hard to occur in the partition walls constituting the honeycomb structure body and thus it is possible to effectively suppress the decrease in isostatic strength of the honeycomb structure.

DESCRIPTION OF THE PREFERRED EMBODIMENTS

Hereinafter, exemplary embodiments of the present invention will be explained. However, the present invention is not limited to the following embodiments. Therefore, it should be understood that modifications, improvements, etc. can be appropriately added to the following embodiments based on the ordinary knowledge of those skilled in the art without departing from the spirit of the present invention.

(1) Honeycomb Structure

Figure 1:
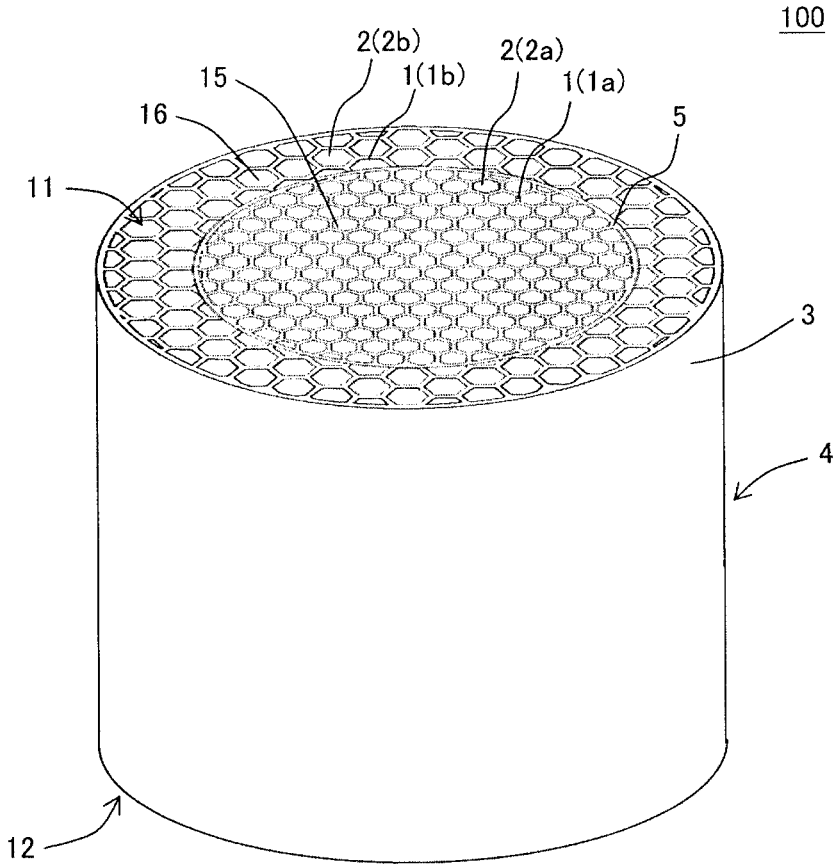
FIG. 1 is a perspective view schematically showing a honeycomb structure according to one embodiment of the present invention.
Figure 2:
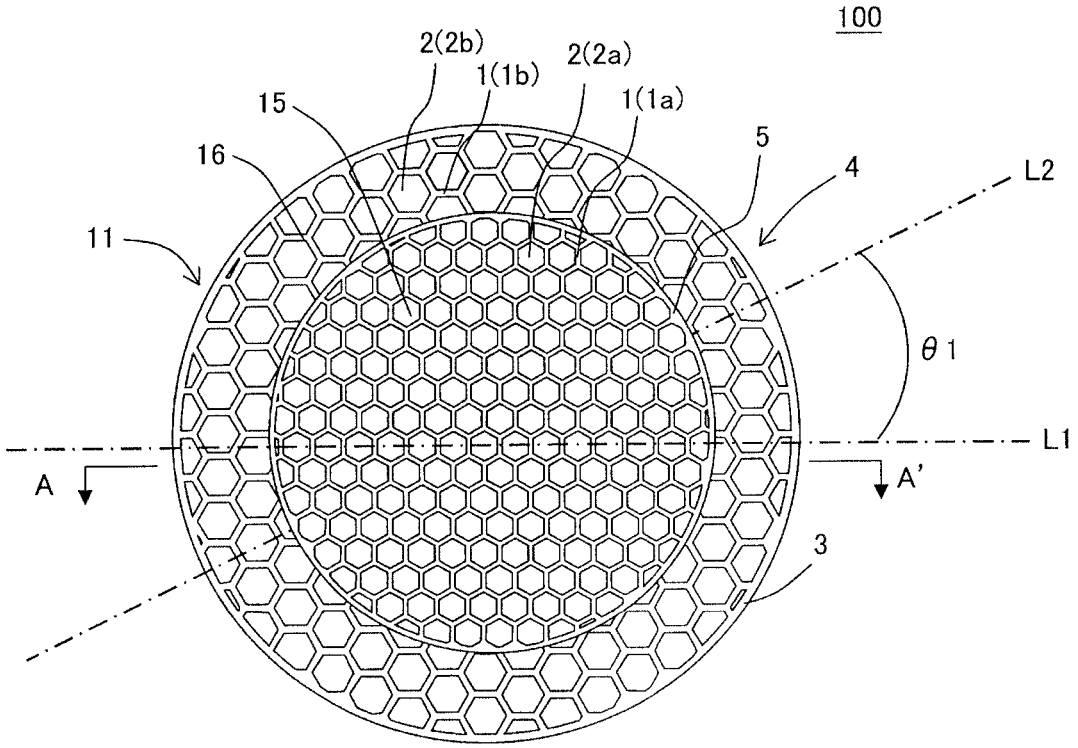
FIG. 2 is a plan view schematically showing a first end face of the honeycomb structure shown in FIG. 1.
Figure 3:
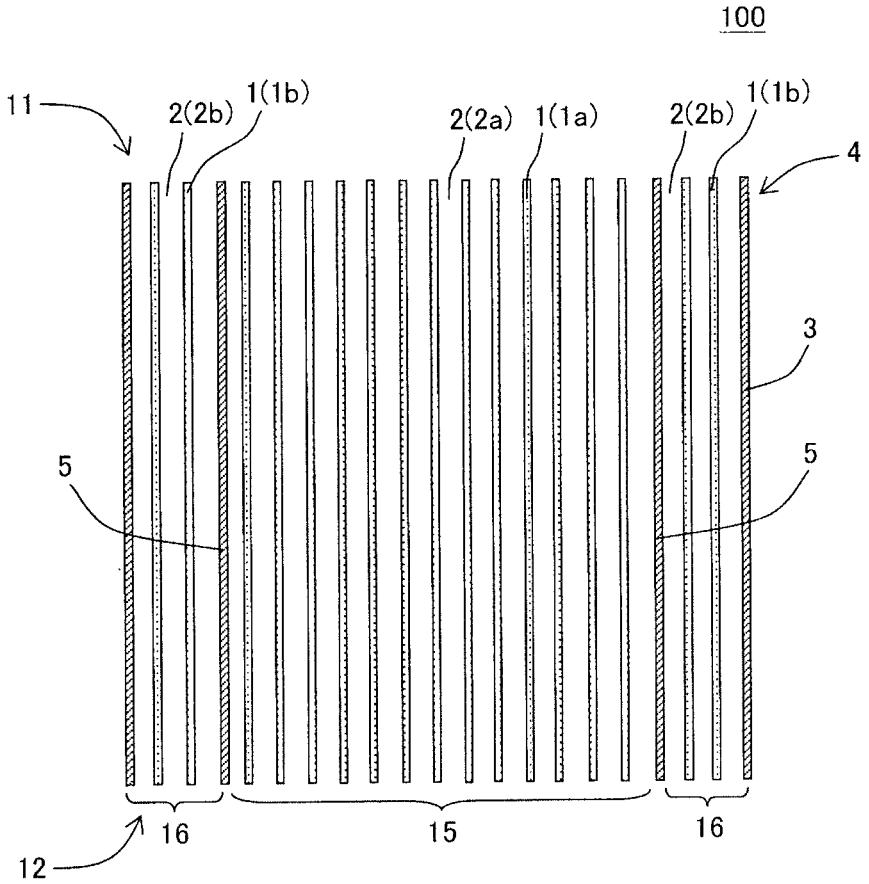
FIG. 3 is a cross-sectional view schematically showing a cross section viewed from the A-A' line in FIG. 2.

As shown in FIGS. 1 to 3, a honeycomb structure according to one embodiment of the present invention is a honeycomb structure 100 that includes a pillar-shaped honeycomb structure body 4 having porous partition walls 1. The honeycomb structure body 4 shown in FIGS. 1 to 3 includes the porous partition walls 1 and a circumferential wall 3 disposed to surround the outer circumference of the partition walls 1. The partition walls 1 of the honeycomb structure body 4 define a plurality of cells 2 functioning as fluid through channels extending from a first end face 11 to a second end face 12. In other words, the partition walls 1 are arranged to surround the plurality of cells 2.

The honeycomb structure 100 according to the present embodiment is characterized in that the honeycomb structure body 4 is configured as described below. In other words, the honeycomb structure body 4 is configured to include a circumferential portion 16 that includes the outermost circumference in a cross section perpendicular to the direction of extension of the cells 2 of the honeycomb structure body 4 and a central portion 15 that is placed in a central portion excluding the circumferential portion 16 in the above cross section. Herein, in the cross section perpendicular to the direction of extension of the cells 2, the shape of the cells 2 is a triangle or a hexagon having at least one symmetrical axis, and the shape of cells 2*a* formed in the central portion 15 and the shape of cells 2*b* formed in the circumferential portion 16 are congruent or similar shapes. In the honeycomb structure 100 shown in FIGS. 1 to 3, "the shape of the cells 2" in the cross section perpendicular to the direction of extension of the cells 2 is a regular hexagon. Moreover, in the honeycomb structure 100 shown in FIGS. 1 to 3, the shape of the cells 2*a* formed in the central portion 15 and the shape of the cells 2*b* formed in the circumferential portion 16 are similar shapes.

In the present specification, "the shape of the cells 2" means the shape when all portions around each of the cells 2 is surrounded by any of the partition walls 1. Hereinafter, among the cells 2, cells in which all portions around each cell are surrounded by any of the partition walls 1 may be called "complete cells". On the other hand, among the cells 2, cells in which all portions around each cell are not surrounded by any of the partition walls 1 and any portion around each the cell is defined by the circumferential wall 3 or the boundary wall 5 may be called "incomplete cells". For example, as shown in FIG. 2, among the cells 2*b*, a portion of each of cells formed near the circumferential wall 3 is defined by the circumferential wall 3. In terms of such the incomplete cells, the shape of the cells 2 may not be a triangle or a hexagon.

Furthermore, in the honeycomb structure 100 according to the present embodiment, assuming that a value indicated in the following Equation (1) is defined as θ, an arrangement direction L2 of the cells 2*b* in the circumferential portion 16 is inclined in the range of θ−15° to θ+15° with respect to an arrangement direction L1 of the cells 2*a* in the central portion 15. In the following Equation (1), "A" indicates the number (pcs) of symmetrical axes in the shape of the cells 2 and "N" indicates the number (pcs) of vertices of the shape of the cells 2. In FIGS. 1 to 3, the number of symmetrical axes in the shape of the cells 2 is 6 pcs (3 pcs to connect the opposing vertices and 3 pcs to connect the midpoints of the opposing sides), and the number of vertices of the shape of the cells 2 is 6 pcs. Therefore, the value of 0 in the following Equation (1) is 30°. Herein, the honeycomb structure 100 shown in FIGS. 1 to 3 shows the case where the above arrangement direction L2 is inclined by 30° with respect to the above arrangement direction L1. Hereinafter, an angle between the arrangement direction L1 of the cells 2*a* in the central portion 15 and the arrangement direction L2 of the cells 2*b* in the circumferential portion 16 is regarded as an "angle θ1".

$$\theta = \frac{180}{A} \cdot \frac{N}{6} \qquad \text{Equation (1)}$$

The honeycomb structure 100 configured as described above has an effect that the decrease in isostatic strength can be suppressed. In other words, in the honeycomb structure 100, even when a pressure from the outside or a thermal stress under high temperature environment is added, distortion is hard to occur in the partition walls 1 constituting the honeycomb structure body 4 and thus it is possible to effectively suppress the decrease in isostatic strength of the honeycomb structure 100.

Herein, FIG. 1 is a perspective view schematically showing the honeycomb structure according to one embodiment of the present invention. FIG. 2 is a plan view schematically showing the first end face of the honeycomb structure shown in FIG. 1. FIG. 3 is a cross-sectional view schematically showing a cross section viewed from the A-A' line in FIG. 2. In FIGS. 1 to 3, the reference number 1*a* shows the partition wall 1*a* constituting the central portion 15 of the honeycomb structure body 4. The reference number 1*b* shows the partition wall 1*b* constituting the circumferential portion 16 of the honeycomb structure body 4.

In the honeycomb structure 100 shown in FIGS. 1 to 3, if the arrangement direction L2 is parallel to the arrangement direction L1 or an inclination between them is less than θ−15°, distortion becomes easy to occur in the partition walls 1 constituting the honeycomb structure body 4 when a pressure from the outside or a thermal stress under high temperature environment is added. Moreover, when a direction of the arrangement direction L2 with respect to the arrangement direction L1 exceeds θ, the arrangement is symmetrical with θ as the boundary. For this reason, when the inclination of the arrangement direction L2 with respect to the arrangement direction L1 exceeds θ+15°, distortion becomes easy to occur in the partition walls 1 constituting the honeycomb structure body 4 when a pressure from the outside or a thermal stress under high temperature environment is added.

In the honeycomb structure according to the present invention, the cell shape is a triangle or a hexagon and the cell shape formed in the central portion and the cell shape formed in the circumferential portion are congruent or similar shapes. For this reason, each of the arrangement direction L1 of the cells in the central portion and the arrangement direction L2 of the cells in the circumferential portion has the arrangement direction of 3 axes or 6 axes. For this reason, the maximum value of an inclination of the arrangement direction L2 with respect to the arrangement direction L1 is 30° when the cell shape is a regular hexagon for example. When the inclination exceeds 30°, the arrangement is symmetrical with 30° as the boundary.

Herein, as shown in FIG. 2, "the arrangement direction L1 of the cells 2*a* in the central portion 15" means, in a state where cells among the cells 2*a* are arranged in the central portion 15 side by side in a line, the direction of extension of the line consisting of these cells 2*a*. Moreover, "the arrangement direction L2 of the cells 2*b* in the circumferential portion 16" means, in a state where cells among the cells 2*b* are arranged in the circumferential portion 16 side by side in a line, the direction of extension of the line consisting of these cells 2*b*. Herein, in the central portion 15 and the circumferential portion 16, the shapes of the cells 2*a* and 2*b* are congruent or similar shapes. For this reason, in the cells 2*a* and 2*b* having congruent or similar shapes, the arrangement direction L1 and the arrangement direction L2 are regarded as arrangement directions corresponding to each other.

For example, the arrangement direction L1 and the arrangement direction L2 can be obtained by capturing the image of the first end face 11 or the second end face 12 of the honeycomb structure body 4 by using an image capturing device and performing image analysis on the captured image. The image analysis of the captured image can be performed by using image processing software of the product name "NEXIV, VMR-1515" made by Nikon Corporation, for example. Moreover, the size (i.e., the angle θ1) of the inclination of the arrangement direction L2 with respect to the arrangement direction L1 can be obtained by using the image processing software as described above. Moreover, the presence or absence and the number of the symmetrical axes in the shape of the cells 2 can be obtained by using the image processing software as described above. In the present invention, in the image analysis performed by the image processing software as described above, assuming that a straight line passing through a centroid of an end face in the captured image is a symmetrical axis, "symmetry" means that a match rate between areas having the symmetric relation is 90% or more. Assuming that the angle (i.e., the direction of extension of the straight line) of the straight line passing through the centroid of the end face in the captured image is a variable, the "symmetrical axis" is an axis for which a match rate between areas having the symmetric relation is the maximum value.

The arrangement direction L1 and the arrangement direction L2 may be specified by a method other than the method described above as long as the directions are specified by the same standard in the central portion 15 and the circumferential portion 16. For example, in a honeycomb structure 300 shown in FIG. 5, the shape of cells 42 (42*a* and 42*b*) is a triangle and partition walls 41 (41*a* and 41*b*) are arranged to respectively cross a central portion 55 and a circumferential portion 56 on the plane perpendicular to the direction of extension of the cells 42. In such a case, in the central portion 55 and the circumferential portion 56, the directions of extension of the partition walls 41 (41*a* and 41*b*) may be respectively regarded as the arrangement direction L1 and the arrangement direction L2. Moreover, although it is not particularly limited, it is preferable that "at least one symmetrical axis" and "the arrangement direction L1" have a positional relation in which the symmetrical axis and the arrangement direction are perpendicular to each other, for example. The details of the honeycomb structure 300 shown in FIG. 5 will be described later.

The inclination of the arrangement direction L2 of the cells 2*b* in the circumferential portion 16 with respect to the arrangement direction L1 of the cells 2*a* in the central portion 15 is in the range of θ−15° to θ+15°, but is preferably in the range of θ−10° to θ+10° and is further preferably in the range of θ−5° to θ+5°. By employing such the configuration, when a pressure from the outside or a thermal stress under high temperature environment is added, distortion becomes further hard to occur in the partition walls 1 constituting the honeycomb structure body 4. Therefore, it is possible to more effectively suppress the decrease in isostatic strength of the honeycomb structure 100.

In the honeycomb structure 100 shown in FIGS. 1 to 3, the honeycomb structure body 4 includes the porous boundary wall 5 in a boundary portion between the central portion 15 and the circumferential portion 16. Therefore, in the honeycomb structure 100, an area inside from the boundary wall 5 is the central portion 15. It is possible to improve the isostatic strength of the honeycomb structure 100 by including such the boundary wall 5.

Although it is not shown, the boundary portion between the central portion and the circumferential portion of the honeycomb structure body may be configured by a continuous or discontinuous partition wall. In other words, the honeycomb structure according to the present embodiment may not have the boundary wall 5 as shown in FIG. 2 for example. For example, in such the honeycomb structure, in the neighborhood of the boundary between the central portion 15 and the circumferential portion 16 in FIG. 2, the partition wall 1*a* constituting the central portion 15 and the partition wall 1*b* constituting the circumferential portion 16 are arranged to surround the cells 2*a* and the cells 2*b* in a mutually continuous or partially discontinuous state.

Figure 4:
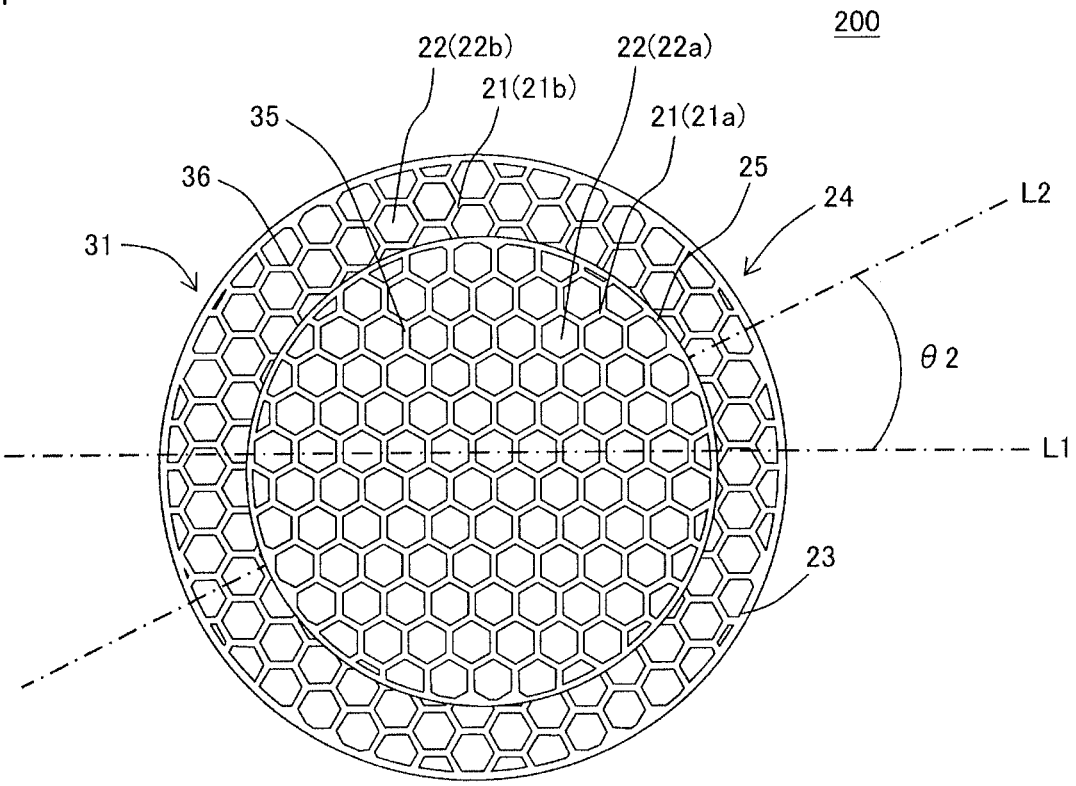
FIG. 4 is a plan view schematically showing a first end face of a honeycomb structure according to another embodiment of the present invention.

Next, a honeycomb structure according to another embodiment of the present invention will be explained with reference to FIG. 4. FIG. 4 is a plan view schematically showing a first end face of a honeycomb structure according to another embodiment of the present invention. As shown in FIG. 4, the honeycomb structure 200 includes a pillar-shaped honeycomb structure body 24 that includes porous partition walls 21 (21*a* and 21*b*). The honeycomb structure body 24 shown in FIG. 4 includes the porous partition walls 21 and a circumferential wall 23 disposed to surround the outer circumference of the partition walls 21. The partition walls 21 of the honeycomb structure body 24 define a plurality of cells 22 functioning as fluid through channels extending from a first end face 31 to a second end face (not shown).

Also in the honeycomb structure 200 shown in FIG. 4, the honeycomb structure body 24 is configured to include a circumferential portion 36 that includes the outermost circumference in a cross section perpendicular to the direction of extension of the cells 22 and a central portion 35 that is arranged in the central portion excluding the circumferential portion 36 on the above cross section. Herein, in the cross section perpendicular to the direction of extension of the cells 22, the shape of the cells 22 is a regular hexagon. In the honeycomb structure 200 shown in FIG. 4, the shape of cells 22*a* formed in the central portion 35 and the shape of cells 22*b* formed in the circumferential portion 36 are congruent. Moreover, also in the honeycomb structure 200 according to the present embodiment, the arrangement direction L2 of the cells 22*b* in the circumferential portion 36 is inclined in the range of θ−15° to 8+15° with respect to the arrangement direction L1 of the cells 22*a* in the central portion 35. In the honeycomb structure 200 shown in FIG. 4, an angle θ2 between the arrangement direction L1 of the cells 22*a* in the central portion 35 and the arrangement direction L2 of the cells 22*b* in the circumferential portion 36 is 30°. In FIG. 4, the reference number 25 shows a boundary wall disposed in a boundary portion between the central portion 35 and the circumferential portion 36.

The honeycomb structure 200 having such the configuration also has an effect that the decrease in isostatic strength can be suppressed. In other words, in the honeycomb structure 200, even when a pressure from the outside or a thermal stress under high temperature environment is added, distortion becomes hard to occur in the partition walls 21 constituting the honeycomb structure body 24 and thus it is possible to effectively suppress the decrease in isostatic strength of the honeycomb structure 200.

Figure 5:
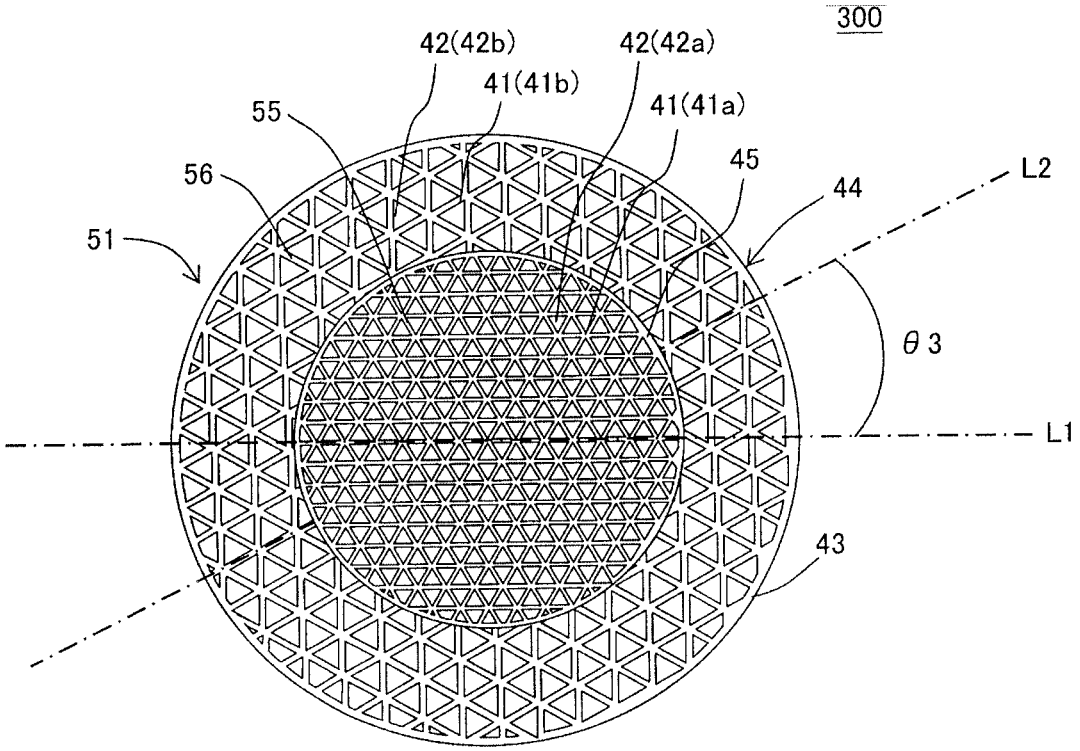
FIG. 5 is a plan view schematically showing a first end face of a honeycomb structure according to further another embodiment of the present invention.

Next, a honeycomb structure according to further another embodiment of the present invention will be explained with reference to FIG. 5. FIG. 5 is a plan view schematically showing a first end face of a honeycomb structure according to further another embodiment of the present invention. As shown in FIG. 5, the honeycomb structure 300 includes a pillar-shaped honeycomb structure body 44 that includes the porous partition walls 41 (41*a* and 41*b*). The honeycomb structure body 44 shown in FIG. 5 includes the porous partition walls 41 and a circumferential wall 43 disposed to surround the outer circumference of the partition walls 41. The partition walls 41 of the honeycomb structure body 44 define the plurality of cells 42 functioning as fluid through channels extending from a first end face 51 to a second end face (not shown).

Also in the honeycomb structure 300 shown in FIG. 5, the honeycomb structure body 44 is configured to include the circumferential portion 56 that includes the outermost circumference in a cross section perpendicular to the direction of extension of the cells 42 and the central portion 55 that is arranged in the central portion excluding the circumferential portion 56 on the above cross section. In the honeycomb structure 300 shown in FIG. 5, in the cross section perpendicular to the direction of extension of the cells 42, the shape of the cells 42 is a regular triangle. In the honeycomb structure 300 shown in FIG. 5, the shape of the cells 42*a* formed in the central portion 55 and the shape of the cells 42*b* formed in the circumferential portion 56 are similar shapes. Also in the honeycomb structure 300, the arrangement direction L2 of the cells 42*b* in the circumferential portion 56 is inclined in the range of θ−15° to θ+15° with respect to the arrangement direction L1 of the cells 42*a* in the central portion 55. In the honeycomb structure 300 shown in FIG. 5, an angle θ3 between the arrangement direction L1 of the cells 42*a* in the central portion 55 and the arrangement direction L2 of the cells 42*b* in the circumferential portion 56 is 30°. In FIG. 5, the reference number 45 shows a boundary wall disposed in a boundary portion between the central portion 55 and the circumferential portion 56.

The honeycomb structure 300 having such the configuration also has an effect that the decrease in isostatic strength can be suppressed. In other words, in the honeycomb structure 300, even when a pressure from the outside or a thermal stress under high temperature environment is added, distortion becomes hard to occur in the partition walls 41 constituting the honeycomb structure body 44 and thus it is possible to effectively suppress the decrease in isostatic strength of the honeycomb structure 300.

As shown in FIGS. 1 to 3, when the shape of the cells 2*a* formed in the central portion 15 and the shape of the cells 2*b* formed in the circumferential portion 16 are similar shapes, it is preferable that the hydraulic diameter of the cells 2*a* formed in the central portion 15 is smaller than the hydraulic diameter of the cells 2*b* constituting the circumferential portion 16. By employing such the configuration, in the plane perpendicular to the direction of extension of the cells 2, exhaust gas can be easily caused to flow into the circumferential portion 16 and thus exhaust gas can be efficiently brought into contact with the honeycomb structure 100 and be purified. In addition, when the shape of the cells 2*a* formed in the central portion 15 and the shape of the cells 2*b* formed in the circumferential portion 16 are similar shapes, the arrangement of the cells 2*a* in the central portion 15 and the arrangement of the cells 2*b* in the circumferential portion 16 have similar shapes.

The hydraulic diameter of the cells 2*a* formed in the central portion 15 is preferably from 0.60 to 1.30 mm and is further preferably from 0.80 to 1.20 mm. Moreover, when comparing the hydraulic diameter of the cells 2*a* formed in the central portion 15 with the hydraulic diameter of the cells 2*b* formed in the circumferential portion 16, it is preferable to satisfy the following relation. In other words, the value of the hydraulic diameter of the cells 2*a* formed in the central portion 15 is preferably from 5 to 40% smaller than and is further preferably from 10 to 30% smaller than the hydraulic diameter of the cells 2*b* formed in the circumferential portion 16. The hydraulic diameter of the cells 2*a* formed in the central portion 15 is a circular tube diameter equal to a cross section (i.e., a through-channel cross section of each of the cells 2*a*) of each of the cells 2*a* formed in the central portion 15 in the plane perpendicular to the direction of extension of the cells 2.

As shown in FIGS. 1 to 3, when the shape of the cells 2*a* formed in the central portion 15 and the shape of the cells 2*b* formed in the circumferential portion 16 are similar shapes, it is preferable that the cell density of the central portion 15 is larger than the cell density of the circumferential portion 16. By employing such the configuration, in the plane perpendicular to the direction of extension of the cells 2, exhaust gas can be easily caused to flow into the cells 2*b* of the circumferential portion 16 and thus exhaust gas can be efficiently brought into contact with the honeycomb structure 100 and be purified.

The cell density of the central portion 15 is preferably from 20 to 170 cells/cm$^2$ and is further preferably from 30 to 150 cells/cm$^2$. When the cell density of the central portion 15 is less than 20 cells/cm$^2$, it may become difficult to ensure the strength of the honeycomb structure 100 and it may become difficult to make exhaust gas flow into the circumferential portion 16. Moreover, when the cell density of the central portion 15 exceeds 170 cells/cm$^2$, the pressure loss of the honeycomb structure 100 may be increased and, when loading a catalyst, the clogging of the cells 2 may easily occur due to the loaded catalyst.

The cell density of the circumferential portion 16 is preferably from 10 to 130 cells/cm$^2$ and is further preferably from 20 to 100 cells/cm$^2$. When the cell density of the circumferential portion 16 is less than 10 cells/cm$^2$, the strength of the honeycomb structure 100 may be short. Moreover, when the cell density of the circumferential portion 16 exceeds 130 cells/cm$^2$, the pressure loss of the honeycomb structure 100 may be increased and, when loading a catalyst, the clogging of the cells 2 may easily occur due to the loaded catalyst.

When the shapes of the cells 2 in the central portion 15 and the circumferential portion 16 are a hexagon in the cross section perpendicular to the direction of extension of the cells 2, this hexagon is a hexagon having at least one symmetrical axis. Such a hexagon can include a regular hexagon or a long hexagon obtained by uniaxially expanding or reducing the regular hexagon. By employing such a hexagon, the arrangement of the cells 2 configured by repeating the plurality of cells 2 in the central portion 15 and the circumferential portion 16 tends to have a straight shape. In addition, it is preferable that the shape of each of the cells 2*a* formed in the central portion 15 are the same shape and the shape of each of the cells 2*b* formed in the circumferential portion 16 are the same shape.

As shown in FIG. 5, when the shapes of the cells 42 in the central portion 55 and the circumferential portion 56 are a triangle in the cross section perpendicular to the direction of extension of the cells 42, this triangle includes a regular triangle and an isosceles triangle other than the regular triangle. By employing such a triangle, the arrangement of the cells 42 configured by repeating the plurality of cells 42 in the central portion 55 and the circumferential portion 56 tends to have a straight shape. In addition, it is preferable that the shapes of the cells 42*a* formed in the central portion 55 are the same shape and the shapes of the cells 42*b* formed in the circumferential portion 56 are the same shape.

In the honeycomb structure 100 as shown in FIGS. 1 to 3, the size of the central portion 15 in the cross section perpendicular to the direction of extension of the cells 2 has no particular limitation. For example, the area of the central portion 15 with respect to the total area of the honeycomb structure body 4 in the cross section perpendicular to the direction of extension of the cells 2 is preferably from 30 to 70% and is further preferably from 40 to 60%. The total area of the honeycomb structure body 4 and the area of the central portion 15 in the cross section perpendicular to the direction of extension of the cells 2 are an area including the opening area of the cells 2 in this cross section.

The thickness of the partition wall 1 in the central portion 15 is preferably from 0.02 to 0.15 mm and is further preferably from 0.05 to 0.10 mm. When the thickness of the partition wall 1 in the central portion 15 is too thin, it may become difficult to ensure the strength of the honeycomb structure 100 and it may become difficult to make exhaust gas flow into the circumferential portion 16. When the thickness of the partition wall 1 in the central portion 15 is too thick, the pressure loss of the honeycomb structure 100 may be increased and, when loading a catalyst, the clogging of the cells 2 may easily occur due to the loaded catalyst.

The thickness of the partition wall 1 in the circumferential portion 16 is preferably from 0.05 to 0.20 mm and is further preferably from 0.07 to 0.15 mm. When the thickness of the partition wall 1 in the circumferential portion 16 is too thin, it may become hard to ensure the strength of the honeycomb structure 100. When the thickness of the partition wall 1 in the circumferential portion 16 is too thick, the pressure loss of the honeycomb structure 100 may be increased and, when loading a catalyst, the clogging of the cells 2 may easily occur due to the loaded catalyst.

The thickness of the circumferential wall 3 is preferably from 0.1 to 1.0 mm and is further preferably from 0.2 to 0.7 mm. When the thickness of the circumferential wall 3 is too thin, it is not preferable in that the entire mechanical strength of the honeycomb structure 100 is decreased. When the thickness of the circumferential wall 3 is too thick, it is not preferable in that the opening area of the cells 2 of the honeycomb structure 100 may be decreased and the pressure loss may be increased.

It is preferable that the partition walls 1 are made of materials including ceramic. It is preferable that the materials constituting the partition walls 1 include at least one kind of ceramic selected from a group consisting of silicon carbide, silicon-silicon carbide composite material, cordierite, mullite, alumina, spinel, silicon carbide-cordierite composite material, lithium aluminum silicate, and aluminum titanate, for example.

It is preferable that the materials of the boundary wall 5 are the same as the materials constituting the partition walls 1. Moreover, it is preferable that the materials of the circumferential wall 3 are the same as the materials constituting the partition walls 1. In the honeycomb structure 100 according to the present embodiment, it is particularly preferable that the partition walls 1, the boundary wall 5, and the circumferential wall 3 are an integrally formed product formed by the single extrusion.

The porosity of the partition walls 1 of the honeycomb structure body 4 is preferably from 5 to 60%, is further preferably from 10 to 50%, and is particularly preferably from 20 to 40%. When the porosity of the partition walls 1 is less than 5%, the pressure loss may be increased when the honeycomb structure 100 is used as a filter. When the porosity of the partition walls 1 exceeds 60%, the strength of the honeycomb structure 100 becomes insufficient and it may become difficult to hold the honeycomb structure 100 with sufficient gripping force when housing the honeycomb structure 100 in a can body used for an exhaust gas purification device. The porosity of the partition walls 1 is a value measured by a mercury porosimeter. For example, the mercury porosimeter can include Autopore 9500 (product name) made by Micromeritics Corp.

The entire shape of the honeycomb structure 100 has no particular limitation. As to the entire shape of the honeycomb structure 100 according to the present embodiment, the shape of the first end face 11 and the second end face 12 is preferably a circular shape or an elliptical shape and is particularly preferably a circular shape. Moreover, the size of the honeycomb structure 100 is not particularly limited, but it is preferable that the length from the first end face 11 to the second end face 12 is from 25 to 200 mm. Moreover, when the entire shape of the honeycomb structure 100 is a round pillar shape, it is preferable that the diameter of the end face of the honeycomb structure 100 is from 50 to 200 mm.

The honeycomb structure 100 according to the present embodiment can be preferably used as an exhaust gas purification member of an internal combustion engine. For example, the honeycomb structure 100 can be preferably used as a catalyst carrier to load a catalyst for exhaust gas purification. The honeycomb structure 100 according to the present embodiment may load a catalyst for exhaust gas purification on/in at least one of the surfaces of the partition walls 1 and the pores of the partition walls 1 of the honeycomb structure body 4.

Moreover, although it is not shown, the honeycomb structure according to the present embodiment may further include plugging portions that are arranged at either one of both ends of the cells surrounded by the partition walls. In other words, the plugging portions are arranged at either one end portion of the inflow side or the outflow side of the cells to seal this end portion of the cells. The honeycomb structure further including the plugging portions can be used as a filter to remove particulate matter in exhaust gas.

(2) Method of Manufacturing Honeycomb Structure

Next, a method of manufacturing honeycomb structures according to the present invention will be explained.

First, a plastic kneaded material to make a honeycomb structure body is made. The kneaded material to make the honeycomb structure body can be made as raw material powder by appropriately adding water and an additive such as a binder to a material selected from the preferable material group of the partition walls described above.

Next, a pillar-shaped honeycomb formed body having partition walls defining a plurality of cells and a circumferential wall disposed on the outermost circumference is obtained by extruding the made kneaded material. In the extrusion molding, a die for extrusion molding can employ a die in which a slit having the inverted shape of the honeycomb formed body to be molded is formed on the extruded surface of the kneaded material. Particularly, when manufacturing the honeycomb structures according to the present invention, it is preferable that a die for extrusion molding employs a die in which a slit is formed so that the arrangement of each of the cells in the central portion and the circumferential portion of the honeycomb formed body to be extruded are inclined in the range of $\theta-15°$ to $\theta+15°$.

The obtained honeycomb formed body may be dried by using microwave and hot air, for example. Moreover, plugging portions may be arranged by plugging the open ends of the cells with the same material as the material used for manufacturing the honeycomb formed body.

Next, a honeycomb structure is obtained by firing the obtained honeycomb formed body. A firing temperature and a firing environment are different depending on a raw material, and those skilled in the art can select the most suitable firing temperature and firing environment for the selected material. In addition, the method of manufacturing the honeycomb structure according to the present invention is not limited to the method described above.

EXAMPLES

Hereinafter, the present invention will be described in further detail based on Examples, but the present invention is not limited to these Examples.

Example 1

A kneaded material was prepared by adding a dispersing medium of 35 parts by mass, an organic binder of 6 parts by mass, and a dispersing agent of 0.5 parts by mass to a cordierite forming raw material of 100 parts by mass and by mixing and kneading these. Alumina, aluminum hydroxide, kaolin, talc, and silica were used as the cordierite forming raw material. Water was used as the dispersing medium, cokes having an average particle diameter of 1 to 10 μm was used as the pore former, hydroxypropyl methylcellulose was used as the organic binder, and ethylene glycol was used as the dispersing agent.

Next, a honeycomb formed body whose entire shape is a round pillar shape was obtained by extruding the kneaded material by using a die for making the honeycomb formed body. In the extrusion molding, as a die for extrusion molding a die in which a regular hexagonal lattice-shaped slit is formed on the extruded surface was used. The regular hexagonal lattice-shaped slit formed on the die had regular hexagons with similar shapes in the central portion and the circumferential portion of the honeycomb formed body to be extruded. Moreover, the regular hexagonal lattice-shaped slit was formed so that the arrangement of each of the cells are inclined 15° in the central portion and the circumferential portion of the honeycomb formed body to be extruded.

Next, the honeycomb formed body was adjusted to a predetermined size by drying the obtained honeycomb formed body with a microwave dryer and further completely drying the body with a hot-air drying machine and then cutting both end faces of the honeycomb formed body.

Next, a honeycomb structure according to Example 1 was manufactured by degreasing and firing the dried honeycomb formed body. The honeycomb structure according to Example 1 had a round pillar shape whose diameter of an end face is 118 mm. In the honeycomb structure, the length of the cell in the extending direction of the cells was 118 mm.

In the honeycomb structure according to Example 1, the shape of the cells formed in the central portion and the shape of the cells formed in the circumferential portion in the plane perpendicular to the extending direction of the cells were both a hexagon. In this regard, however, the shape of the cells formed in the central portion and the shape of the cells formed in the circumferential portion were similar shapes and an angle between the arrangement direction of the cells in the central portion and the arrangement direction of the cells in the circumferential portion was 15°. The column of "Angle)(° between cell arrangements" of Table 1 shows the size of an angle between the arrangement direction of the cells in the central portion and the arrangement direction of the cells in the circumferential portion. Moreover, "Number (pcs) of symmetrical axes" and "Value of θ of Equation (1)" of the shape of the cells in the honeycomb structure according to Example 1 are shown in Table 1.

The central portion of the honeycomb structure according to Example 1 had, in the end face of the honeycomb structure body, the shape of a circle and the diameter of 83 mm. The central portion had the thickness of the partition wall of 0.090 mm and the cell density of 81 cells/cm$^2$. Moreover, the circumferential portion of the honeycomb structure according to Example 1 had the thickness of the partition wall of 0.115 mm and the cell density of 54 cells/cm$^2$. The column of "Central portion" of Table 1 shows the thickness of the partition wall and the cell density of the central portion and the diameter of the central portion. The column of "Circumferential portion" of Table 1 shows the thickness of the partition wall and the cell density of the circumferential portion and the diameter (i.e., the outer diameter of the honeycomb structure) of the circumferential portion.

Examples 4 and 5 and Comparative Examples 3 and 4

In Examples 4 and 5 and Comparative Examples 3 and 4, honeycomb structures were made so that the shape of the cells formed in the central portion and the shape of the cells formed in the circumferential portion are congruent to each other. The thicknesses of the partition walls and the cell densities of the central portions and the circumferential portions in the honeycomb structures according to Examples 4 and 5 and Comparative Examples 3 and 4 are shown in Table 1.

TABLE 1

| | | Central portion | | | Circumferential portion | | | | | | |
|---|---|---|---|---|---|---|---|---|---|---|---|
| | Cell shape | Partition wall thickness (mm) | Cell density (cells/cm$^2$) | Diameter (ID) (mm) | Partition wall thickness (mm) | Cell density (cells/cm$^2$) | Diameter (OD) (mm) | Angle (°) between cell arrangement | Number (pcs) of symmetrical axes | Value of θ of Equation (1) | Evaluation Isostatic strength |
| Comp. Ex. 2 | Regular hexagon | 0.09 | 81 | 83 | 0.115 | 54 | 118 | 10 | 6 | 30 | D |
| Example 1 | Regular hexagon | 0.09 | 81 | 83 | 0.115 | 54 | 118 | 15 | 6 | 30 | C |
| Example 2 | Regular hexagon | 0.09 | 81 | 83 | 0.115 | 54 | 118 | 20 | 6 | 30 | B |
| Example 3 | Regular hexagon | 0.09 | 81 | 83 | 0.115 | 54 | 118 | 30 | 6 | 30 | A |
| Comp. Ex. 1 | Regular hexagon | 0.09 | 81 | 83 | 0.115 | 54 | 118 | 0 | 6 | 30 | — |
| Comp. Ex. 4 | Regular hexagon | 0.09 | 81 | 83 | 0.09 | 81 | 83 | 10 | 6 | 30 | D |
| Example 4 | Regular hexagon | 0.09 | 81 | 83 | 0.09 | 81 | 83 | 20 | 6 | 30 | B |
| Example 5 | Regular hexagon | 0.09 | 81 | 83 | 0.09 | 81 | 83 | 30 | 6 | 30 | A |
| Comp. Ex. 3 | Regular hexagon | 0.09 | 81 | 83 | 0.09 | 81 | 83 | 0 | 6 | 30 | — |
| Comp. Ex. 6 | Long hexagon | 0.09 | 81 | 83 | 0.09 | 81 | 83 | 70 | 2 | 90 | D |
| Example 6 | Long hexagon | 0.09 | 81 | 83 | 0.09 | 81 | 83 | 80 | 2 | 90 | B |
| Example 7 | Long hexagon | 0.09 | 81 | 83 | 0.09 | 81 | 83 | 90 | 2 | 90 | A |
| Comp. Ex. 5 | Long hexagon | 0.09 | 81 | 83 | 0.09 | 81 | 83 | 0 | 2 | 90 | — |

Examples 2 and 3 and Comparative Examples 1 and 2

Honeycomb structures according to Examples 2 and 3 and Comparative Examples 1 and 2 were manufactured similarly to Example 1 except that the sizes of angles between the arrangement direction of the cells in the central portion and the arrangement direction of the cells in the circumferential portion are changed as shown in Table 1.

The evaluation for isostatic strength was performed in the following method on the honeycomb structures according to Examples 1 to 3 and Comparative Examples 1 and 2. The results are shown in Table 1.

Isostatic Strength

The following evaluation is made by the rate of improvement of the isostatic strength by using as a reference the isostatic strength of the honeycomb structure in which the arrangement direction of the cells in the circumferential portion is aligned with the arrangement direction of the cells in the central portion. For example, when the evaluation is performed on Examples 1 to 3 and Comparative Examples 1 and 2, a honeycomb structure as a reference is the honeycomb structure according to Comparative Example 1.

Evaluation A: the case where the rate of improvement of isostatic strength is not less than 20% with respect to the reference is Excellent and is regarded as Evaluation A.

Evaluation B: the case where the rate of improvement of isostatic strength is not less than 10% with respect to the reference is Good and is regarded as Evaluation B.

Evaluation C: the case where the rate of improvement of isostatic strength is larger than 0% and is less than 10% with respect to the reference is Acceptable and is regarded as Evaluation C.

Evaluation D: the case where the rate of improvement of isostatic strength is not present with respect to the reference is Unacceptable and is regarded as Evaluation D.

Examples 6 and 7 and Comparative Examples 5 and 6

In Examples 6 and 7 and Comparative Examples 5 and 6, honeycomb structures were made so that the shape of the cells formed in the central portion and the shape of the cells formed in the circumferential portion are congruent to each other. In this regard, however, the shape of the cells was changed to a long hexagon obtained by uniaxially reducing a regular hexagon. The long hexagon is a hexagon consisting of sides of two different lengths. The thicknesses of the partition walls and the cell densities of the central portions and the circumferential portions in the honeycomb structures according to Examples 6 and 7 and Comparative Examples 5 and 6 are shown in Table 1.

Examples 8 to 10 and Comparative Examples 7 and 8

In Examples 8 to 10 and Comparative Examples 7 and 8, honeycomb structures were made so that the shape of the cells formed in the central portion and the shape of the cells formed in the circumferential portion are regular triangles with similar shapes. The thicknesses of the partition walls and the cell densities of the central portions and the circumferential portions in the honeycomb structures according to Examples 8 to 10 and Comparative Examples 7 and 8 are shown in Table 2.

TABLE 2

| | Cell shape | Central portion | | | Circumferential portion | | | Angle (°) between cell arrangement | Number (pcs) of symmetrical axes | Value of θ of Equation (1) | Evaluation Isostatic strength |
|---|---|---|---|---|---|---|---|---|---|---|---|
| | | Partition wall thickness (mm) | Cell density (cells/cm$^2$) | Diameter (ID) (mm) | Partition wall thickness (mm) | Cell density (cells/cm$^2$) | Diameter (OD) (mm) | | | | |
| Comp. Ex. 8 | Regular triangle | 0.09 | 40 | 83 | 0.115 | 27 | 118 | 10 | 3 | 30 | D |
| Example 8 | Regular triangle | 0.09 | 40 | 83 | 0.09 | 40 | 83 | 15 | 3 | 30 | C |
| Example 9 | Regular triangle | 0.09 | 40 | 83 | 0.115 | 27 | 118 | 20 | 3 | 30 | B |
| Example 10 | Regular triangle | 0.09 | 40 | 83 | 0.115 | 27 | 118 | 30 | 3 | 30 | A |
| Comp. Ex. 7 | Regular triangle | 0.09 | 40 | 83 | 0.115 | 27 | 118 | 0 | 3 | 30 | — |
| Comp. Ex. 10 | Regular triangle | 0.09 | 40 | 83 | 0.09 | 40 | 83 | 10 | 3 | 30 | D |
| Example 11 | Regular triangle | 0.09 | 40 | 83 | 0.09 | 40 | 83 | 20 | 3 | 30 | B |
| Example 12 | Regular triangle | 0.09 | 40 | 83 | 0.09 | 40 | 83 | 30 | 3 | 30 | A |
| Comp. Ex. 9 | Regular triangle | 0.09 | 40 | 83 | 0.09 | 40 | 83 | 0 | 3 | 30 | — |
| Comp. Ex. 12 | Isosceles triangle | 0.09 | 53 | 83 | 0.115 | 35 | 118 | 70 | 1 | 90 | D |
| Example 13 | Isosceles triangle | 0.09 | 53 | 83 | 0.115 | 35 | 118 | 75 | 1 | 90 | C |
| Example 14 | Isosceles triangle | 0.09 | 53 | 83 | 0.115 | 35 | 118 | 80 | 1 | 90 | B |
| Example 15 | Isosceles triangle | 0.09 | 53 | 83 | 0.115 | 35 | 118 | 90 | 1 | 90 | A |
| Comp. Ex. 11 | Isosceles triangle | 0.09 | 53 | 83 | 0.115 | 35 | 118 | 0 | 1 | 90 | — |
| Comp. Ex. 14 | Regular hexagon | 0.09 | 81 | 83 | 0.115 | 54 | 118 | 10 | 6 | 30 | D |
| Example 16 | Regular hexagon | 0.09 | 81 | 83 | 0.115 | 54 | 118 | 20 | 6 | 30 | C |
| Example 17 | Regular hexagon | 0.09 | 81 | 83 | 0.115 | 54 | 118 | 20 | 6 | 30 | B |
| Example 18 | Regular hexagon | 0.09 | 81 | 83 | 0.115 | 54 | 118 | 30 | 6 | 30 | A |
| Comp. Ex. 13 | Regular hexagon | 0.09 | 81 | 83 | 0.115 | 54 | 118 | 0 | 6 | 30 | — |

Examples 11 and 12 and Comparative Examples 9 and 10

In Examples 11 and 12 and Comparative Examples 9 and 10, honeycomb structures were made so that the shape of the cells formed in the central portion and the shape of the cells formed in the circumferential portion are regular triangles with congruent shapes. The thicknesses of the partition walls and the cell densities of the central portions and the circumferential portions in the honeycomb structures according to Examples 11 and 12 and Comparative Examples 9 and 10 are shown in Table 2.

Examples 13 to 15 and Comparative Examples 11 and 12

In Examples 13 to 15 and Comparative Examples 11 and 12, honeycomb structures were made so that the shape of the cells formed in the central portion and the shape of the cells formed in the circumferential portion are isosceles triangles with similar shapes. The thicknesses of the partition walls and the cell densities of the central portions and the circumferential portions in the honeycomb structures according to Examples 13 to 15 and Comparative Examples 11 and 12 are shown in Table 2. An isosceles triangle is a triangle whose angle of a vertex angle is 30°.

Examples 16 to 18 and Comparative Examples 13 and 14

In Examples 16 to 18 and Comparative Examples 13 and 14, Honeycomb structures were made so that the shape of the cells formed in the central portion and the shape of the cells formed in the circumferential portion are regular hexagons with similar shapes. The thicknesses of the partition walls and the cell densities of the central portions and the circumferential portions in the honeycomb structures according to Examples 16 to 18 and Comparative Examples 13 and 14 are shown in Table 2. In Examples 16 to 18 and Comparative Examples 13 and 14, each the honeycomb structure was configured by a partition wall where the central portion and the circumferential portion are continuous without providing a boundary wall in a boundary between the central portion and the circumferential portion.

In addition, the manufacturing of the honeycomb structures according to Examples 4 to 18 and Comparative Examples 3 to 14 was performed by using the same method as that of Example 1 except that extrusion is performed by using a die in which a slit corresponding to the shape of each cell explained so far is formed.

The evaluations for isostatic strength were performed on the honeycomb structures according to Examples 4 to 18 and Comparative Examples 3 to 14 in the same manner as in Example 1. The results are shown in Table 1 and Table 2. In addition, the reference of isostatic strength in each evaluation was Comparative Examples 3, 5, 7, 9, 11, and 13 for Examples of the same cell shape.

(Result)

As will be appreciated from the results shown in Tables 1 and 2, the honeycomb structures according to Examples 1 to 18 showed good results about the evaluation for isostatic strength. On the other hand, the honeycomb structures according to Comparative Examples 2, 4, 6, 8, 10, 12, and 14 did not show the improvement of the isostatic strength with respect to the honeycomb structure as a reference.

INDUSTRIAL APPLICABILITY

The honeycomb structures according to the present invention can be used as a catalyst carrier loading a catalyst to purify exhaust gas emitted from a gasoline engine, a diesel engine, etc., and as a filter to purify exhaust gas.

DESCRIPTION OF REFERENCE NUMERALS

1, 1*a*, 1*b*, 21, 21*a*, 21*b*, 41, 41*a*, 41*b*: partition wall, 2, 22, 42: cell, 2*a*, 22*a*, 42*a*: cell (cell in central portion), 2*b*, 22*b*, 42*b*: cell (cell in circumferential portion), 3, 23, 43: circumferential wall, 4, 24, 44: honeycomb structure body, 5, 25, 45: boundary wall, 11, 31, 51: first end face, 12: second end face, 100, 200, 300: honeycomb structure, L1: arrangement direction of cells in central portion, L2: arrangement direction of cells in circumferential portion, θ1, θ2, θ3: angle (angle between arrangement direction of cells in central portion and arrangement direction of cells in circumferential portion).

What is claimed is:

1. A honeycomb structure comprising:

a pillar-shaped honeycomb structure body that includes porous partition walls arranged to surround a plurality of cells functioning as fluid through channels extending from a first end face to a second end face, the honeycomb structure body being configured to include a circumferential portion that includes an outermost circumference in a cross section perpendicular to a direction of extension of the cells of the honeycomb structure body and a central portion that is arranged in a central portion excluding the circumferential portion in the cross section, wherein in the cross section perpendicular to the direction of extension of the cells, a shape of the cells is a triangle or a hexagon having at least one symmetrical axis, and a shape of the cells formed in the central portion and a shape of the cells formed in the circumferential portion are congruent or similar shapes, in the shape of the cells, a number of the symmetrical axes is defined as A, a number of vertices of the shape of the cells is defined as N, and a value shown in a following Equation (1) is defined as θ, an arrangement direction of the cells in the circumferential portion is inclined in a range of θ−15° to θ+15° with respect to an arrangement direction of the cells in the central portion $$\theta = \frac{180}{A} \cdot \frac{N}{6}. \qquad \text{Equation (1)}$$

2. The honeycomb structure according to claim 1, wherein the honeycomb structure body further includes a boundary wall that is disposed in a boundary portion between the central portion and the circumferential portion.

3. The honeycomb structure according to claim 1, wherein a boundary portion between the central portion and the circumferential portion in the honeycomb structure body is configured by the partition walls that is continuous or discontinuous.

4. The honeycomb structure according to claim 1, wherein a hydraulic diameter of the cells formed in the central portion is smaller than a hydraulic diameter of the cells formed in the circumferential portion.

5. The honeycomb structure according to claim 1, wherein a cell density in the central portion is larger than a cell density in the circumferential portion.

6. The honeycomb structure according to claim 1, further comprising plugging portions that are arranged at either end of the first end face or the second end face of the cells.

* * * * *